United States Patent [19]

Watson, Jr.

[11] Patent Number: 5,048,128

[45] Date of Patent: Sep. 17, 1991

[54] PROTECTIVE HEADWEAR

[76] Inventor: John C. Watson, Jr., P.O. Box 9241, Calabasas, Calif. 91372

[21] Appl. No.: 674,875

[22] Filed: Mar. 11, 1991

[51] Int. Cl.[5] ..... A42B 1/04

[52] U.S. Cl. ..... 2/204; 2/171; 2/174; 2/175; 2/177; 2/202; 2/207; 2/195; 2/196; 2/198; 2/199

[58] Field of Search ..... 2/204, 171, 184.5, 174, 2/202, 207, 195, 196, 198, 199, 175, 177, 185 R; D2/244, 600, 602, 604

[56] References Cited

U.S. PATENT DOCUMENTS

| | | | |
|---|---|---|---|
| 36,315 | 8/1862 | Warburton | 2/207 |
| 39,667 | 8/1863 | Mossman | 2/207 |
| 781,232 | 1/1905 | Saks | 2/207 |
| 1,646,193 | 10/1927 | Farkas | 2/204 |
| 2,574,208 | 11/1951 | Crowthers | 2/207 |
| 2,704,366 | 3/1955 | Arnold | 2/198 |
| 2,735,110 | 2/1956 | Baker | 2/198 |
| 2,767,404 | 10/1956 | Collins | 2/198 |
| 2,859,448 | 11/1958 | Gaichel | 2/207 |
| 2,897,510 | 8/1959 | Forbes-Robinson | 2/198 |
| 2,988,748 | 6/1961 | Rollins-Dudley | 2/202 |
| 3,141,176 | 7/1964 | Neumann | 2/207 |
| 3,671,977 | 6/1972 | Dregnon | 2/207 |

FOREIGN PATENT DOCUMENTS

| | | | |
|---|---|---|---|
| 1187256 | 3/1959 | France | 2/207 |

*Primary Examiner*—Werner H. Schroeder
*Assistant Examiner*—Gloria Hale

[57] ABSTRACT

An article of headwear to protect eyes, ears, neck and shoulders of wearer from the sun's harmful rays during outdoor activities. This protective headwear consists of a semi-rigid visor portion, a kerchief portion and a ribbon portion. The visor is substantially crescent shaped, and the kerchief portion is substantially rectangular. The visor portion is attached to one of the short edges of the rectangular kerchief portion along its concave back edge. The ribbon portion is attached to the concave edge of the visor portion and to the said short edge of the rectangular kerchief portion. The ribbon is of sufficient length to allow the wearer to knot its ends behind ones head. The visor and kerchief portions are attached substantially in the middle region of said ribbon. The article, when dampened can provide evaporative cooling for the wearer in warm conditions, and when worn dry can retain warmth for the wearer in cold conditions.

1 Claim, 1 Drawing Sheet

PROTECTIVE HEADWEAR

PRIOR ART STATEMENT

Some hats are available with visor portions, and some also have one form or another of neck shade. Some neck shades are attached permanently and some are detachable. Most caps have crown portions that are manufactured to size or have a means for limited size adjustments. These types of sport hats all lose their shapes to some degree upon laundering and or rough treatment, rendering them unsightly and ill-fitting. Another disadvantage of these types of hats is that the heavy materials employed in their construction in order to retain the shape of the crown, discourage the natural cooling evaporation of perspiration form the scalp.

SUMMARY OF THE INVENTION

This invention relates to improvements in head covering for men and women designed to versatile for all seasons. My protective headwear provides covering or shading for ones eyes, head, ears, neck and upper shoulders. One of the objects of the invention is the advantage of a crown portion designed to conform to the wearer's individual head shape. The fabric employed in the construction of said invention can be of relatively lightweight, breathable fabric that due to its direct contact with the hair and scalp is able to wick away moisture for evaporation.

Another feature of the invention is to provide a visor to shade the eyes made of a material rigid enough to afford shade to the eyes of the wearer but resilient enough to withstand rough use as well as repeated washing and wetting. By employing a ribbon tie to sustain the headwear in place a proper fit can always be achieved despite fabric shrinkage or stretch.

The invention is inexpensive to manufacture due to its simple design and its dependence on only the most simple technologies for its construction. Another advantage of the invention is its versatility, to be worn wet or dry thereby providing evaporative cooling when worn wet on a warm day or by containing warmth within the head and neck on a cool day.

BRIEF DESCRIPTION OF THE DRAWINGS

In the drawings which are to be merely illustrative.

DESCRIPTION OF PREFERRED EMBODIMENTS

Figure 1:
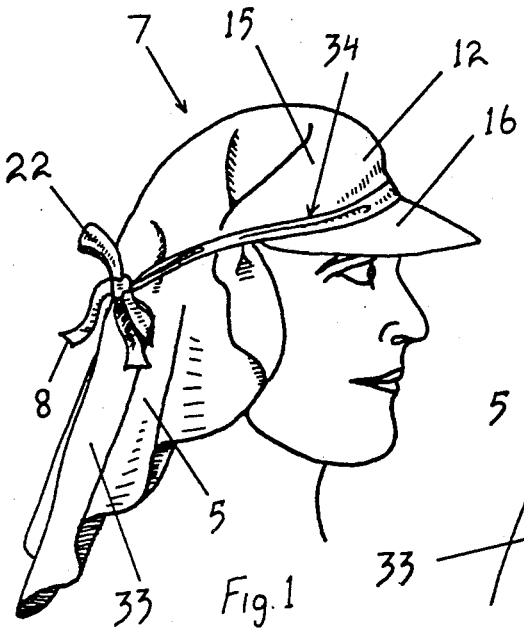
FIG. 1 is a perspective view of the presently preferred embodiment of the invention in position on the wearer.
Figure 2:
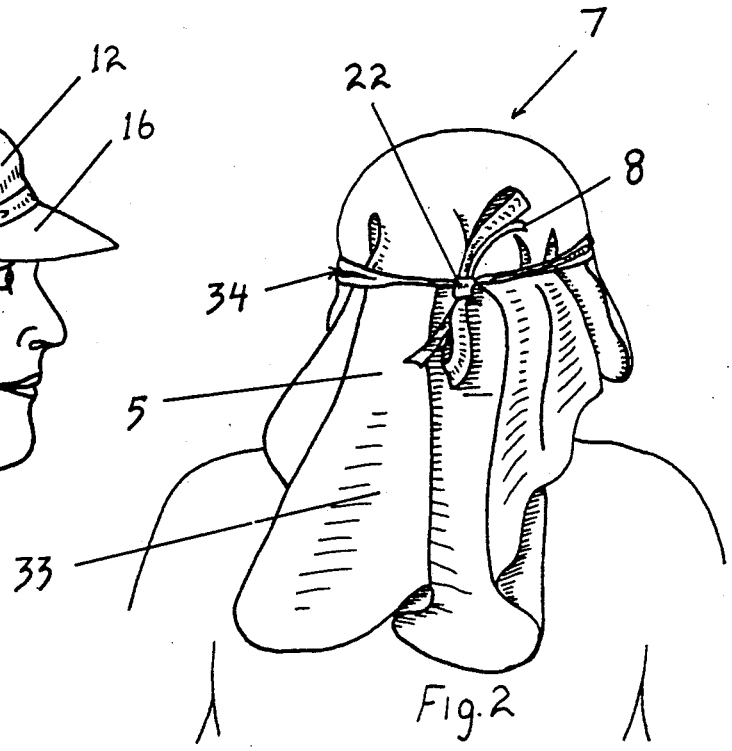
FIG. 2 is a rear elevation of the same.
Figure 3:
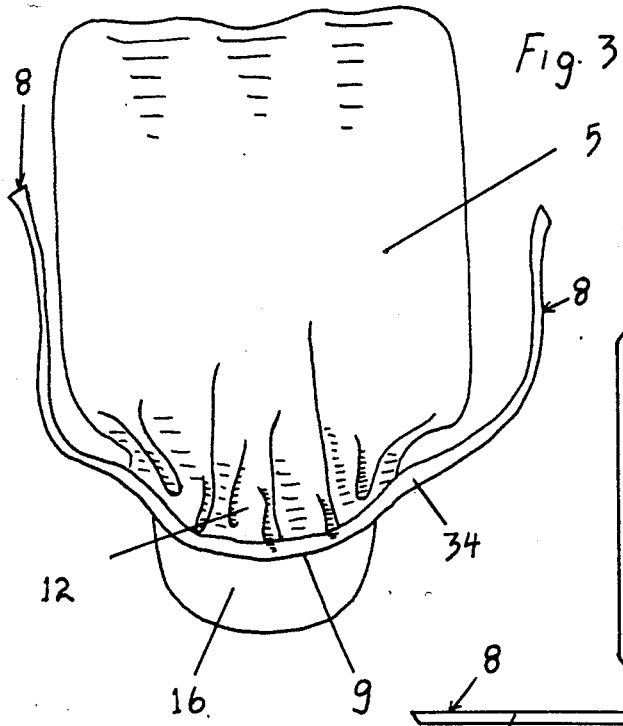
FIG. 3 is a plan view of the invention on a flat surface.
Figure 4:
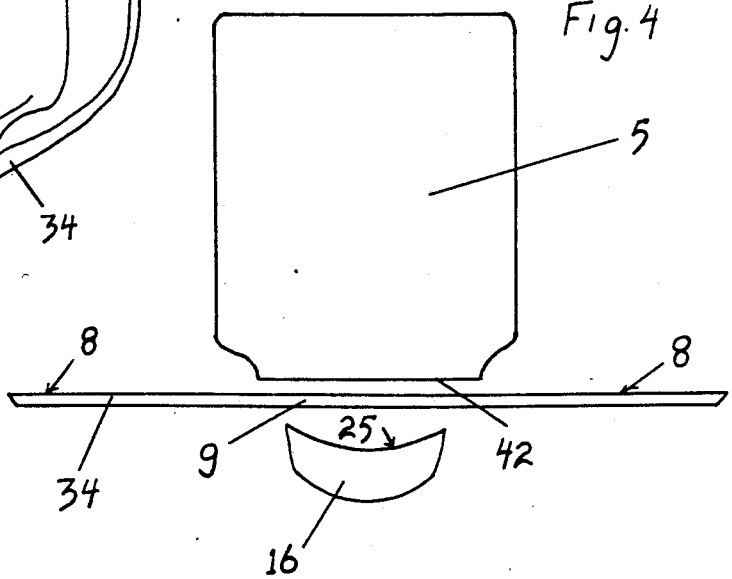
FIG. 4 is a plan view of the several parts employed in construction of the invention.

In the drawings the article of headwear is shown at 7, and embodies in its construction a kerchief portion 5 which is the main head covering and is adapted to cover the head and hang downward at the back, while a visor 16 is provided at the front of the headwear. The visor is of substantially a crescent shape, but may be of any desired shape and style. The visor is constructed of one or more plies of fabric such as canvas or a pack cloth designed to give the desired amount of rigidity and durability. A ribbon 34 is attached to visor 16 along its concave rear edge 25 by stitching or other suitable means to the middle portions of the ribbon 34 and visor 16 is attached by stitching or other suitable means to straight edge 42 of the substantially rectangular kerchief portion 5. The process of joining straight edge 42 to curved edge of visor 25 creates a pucker at 12. This pucker 12 causes a fullness at the forehead region 15 of the wearer and helps achieve the desired fit.

To fit the cap to the wearer's head, the kerchief portion is placed upon the head with the visor positioned suitably on the wearer's forehead. The ribbon ends 8 are then drawn to the rear of the head where they are knotted 22 under suitable tension. A substantial portion of the headwear 33 drapes in loose folds onto the neck and shoulders of the wearer.

I claim:

1. A unisex protective headcovering, comprising a fabric kerchief portion, a visor portion, and a tying ribbon portion designed to protect the wearer's head, eyes, neck, ears and part of the back and shoulder area from the harmful effects of the sun with the option to be worn wet to provide evaporative cooling for the wearer, and said fabric kerchief portion being a substantially rectangular form designed to drape downward at the back of the wearer's head; a visor portion whose rear edge is concave, made of suitably rigid material; and a ribbon portion whose middle region is affixed to one edge of said rectangular portion and also affixed to said visor portion along concave rear edge of visor and whose ends are of sufficient length to be drawn back to the rear of the wearer's head and knotted to secure the head covering in place.

* * * * *